US011318530B1

(12) United States Patent
Cleary et al.

(10) Patent No.: US 11,318,530 B1
(45) Date of Patent: May 3, 2022

(54) SLIDES AND EXPENDABLE CORES FOR HIGH PRESSURE DIE CAST CLOSED DECK ENGINE BLOCK

(71) Applicant: Brunswick Corporation, Mettawa, IL (US)

(72) Inventors: Terrance M. Cleary, Fond du Lac, WI (US); Kevin R. Anderson, Fond du Lac, WI (US); Raymond J. Donahue, Fond du Lac, WI (US); Alexander K. Monroe, Fond du Lac, WI (US); Clayton T. Rasmussen, North Fond du Lac, WI (US)

(73) Assignee: Brunswick Corporation, Mettawa, IL (US)

( * ) Notice: Subject to any disclaimer, the term of this patent is extended or adjusted under 35 U.S.C. 154(b) by 0 days.

(21) Appl. No.: 16/788,847

(22) Filed: Feb. 12, 2020

Related U.S. Application Data

(60) Continuation-in-part of application No. 16/219,480, filed on Dec. 13, 2018, now Pat. No. 10,596,622, which is a division of application No. 15/453,148, filed on Mar. 8, 2017, now Pat. No. 10,189,079.

(51) Int. Cl.

| | |
|---|---|
| ***B22C 9/10*** | (2006.01) |
| ***B22D 17/22*** | (2006.01) |
| ***B22C 9/06*** | (2006.01) |
| *F02F 7/00* | (2006.01) |
| *F02F 1/10* | (2006.01) |

(52) U.S. Cl.
CPC ..... *B22D 17/2263* (2013.01); *B22C 9/06* (2013.01); *B22C 9/064* (2013.01); *B22C 9/105* (2013.01); *B22D 17/229* (2013.01); *F02F 7/0095* (2013.01); *F02F 2001/106* (2013.01); *F02F 2200/06* (2013.01)

(58) Field of Classification Search
CPC .. B22C 9/10; B22C 9/108; B22C 9/06; B22D 17/22
USPC ..... 164/369, 302
See application file for complete search history.

(56) References Cited

U.S. PATENT DOCUMENTS

| | | | | |
|---|---|---|---|---|
| 4,875,517 | A | 10/1989 | Donahue et al. | |
| 4,981,168 | A | 1/1991 | Koch et al. | |
| 5,236,034 | A * | 8/1993 | Cestaro et al. | B22C 9/10 164/367 |
| 6,478,073 | B1 | 11/2002 | Grebe et al. | |
| 6,886,505 | B2 | 5/2005 | Laufenberg et al. | |
| 7,013,948 | B1 | 3/2006 | Grebe et al. | |

(Continued)

*Primary Examiner* — Kevin P Kerns
(74) *Attorney, Agent, or Firm* — Andrus Intellectual Property Law, LLP

(57) ABSTRACT

A slide for the high pressure die casting of at least one closed deck engine block having at least one cylinder is disclosed. The slide includes a tool steel portion with reliefs for forming a water jacket surrounding each cylinder. At least one expendable core is located in each relief, the expendable core having an inner surface and an outer surface with an aperture extending therethrough. The outer surface and inner surface of the expendable core is coextensive with an inner surface and outer surface of the tool steel portion. A method for high pressure die casting a closed deck engine block using the disclosed slide and expendable cores is also disclosed. The expendable cores are separable from the reliefs in the slide, and form bridges or supports across a water jacket to add stiffness and rigidity to the cast engine cylinders.

22 Claims, 9 Drawing Sheets

(56) References Cited

U.S. PATENT DOCUMENTS

| | | | | |
|---|---|---|---|---|
| 8,820,389 | B1 | 9/2014 | Degler | |
| 10,189,079 | B1 | 1/2019 | Cleary et al. | |
| 10,596,622 | B1 * | 3/2020 | Cleary et al. | B22C 9/064 |

* cited by examiner

SLIDES AND EXPENDABLE CORES FOR HIGH PRESSURE DIE CAST CLOSED DECK ENGINE BLOCK

CROSS REFERENCE TO RELATED APPLICATION

This application is a continuation in part application of U.S. patent application Ser. No. 16/219,480, filed Dec. 13, 2018, now U.S. Pat. No. 10,596,622, which is a divisional application of U.S. patent application Ser. No. 15/453,148, filed Mar. 8, 2017, now U.S. Pat. No. 10,189,079, which are incorporated herein by reference.

FIELD

The present disclosure relates to engines and engine Hocks for marine engines, and particularly to expendable cores used in the manufacturing of high pressure die cast closed deck engine blocks.

BACKGROUND

Closed deck engine blocks refer to engine blocks wherein an area between an outer surface of a cylinder bore and an outer surface of a space defining a water jacket that surrounds the outer surface of the cylinder bore are bridged or connected with supporting material to enhance the stability of the cylinder bore during combustion. In contrast, open deck engine blocks refer to engine blocks where the cylinder bores are not supported.

U.S. Pat. No. 8,820,389; which is hereby incorporated herein in entirety by reference; discloses a method for high pressure die casting of an engine block assembly having at least one cast in place cylinder bore in the engine block, and a closed head deck surface. In the disclosed method, an outer upper surface of at least one cast in place cylinder bore is surrounded with a salt core to create a composite core. The salt core defines the water jacket. The composite core is placed into a high pressure die casting mold for a closed deck engine block and an engine block alloy is injected into the mold. The cast engine block and composite core are removed from the high pressure die casting mold as a single engine block assembly and cooled. The salt portion of the composite core is dissolved. In certain embodiments, the salt core defines orifices in the closed head deck. The drawback of this method is that it requires that the cylinder bores be pre-cast and then cast into place using the composite core method. Another drawback is that there is difficulty in removing the large amount of salt used for the salt core.

U.S. Pat. No. 4,875,517 entitled "Method of producing salt cores for use in die casting" and also incorporated herein in entirety by reference, describes a method of producing salt cores for use in traditional die casting (not high pressure) by means of an evaporative foam pattern held in place with sand.

U.S. Pat. No. 7,013,948 entitled "Disintegrative Core for use in use in Die Casting of Metallic Components" and incorporated herein in entirety by reference details the manufacture of salt cores with a vent opening to allow gases to pass inward through the body of the salt core and away from the salt core's outer surface. This salt core technology is used in traditional die casting to produce engine blocks and engine head decks.

However, the high pressure die casting method traditionally has been limited. The use of sand cores made from sand molded within a geometric cavity and held together with an organic binder remain confined to use in low pressure and sand casting methods due to the fragile nature of the core body. Likewise, salt cores are often too fragile to withstand the influx of pressurized molten metal while retaining their necessary shape. Particularly, the intricacies of the head decks of engine blocks are problematic to cast with high pressure die casting because of tight tolerances between cylinder bores and the water cooling jackets surrounding the cylinder bores, which generally require sand or salt core technology. Such engine head decks are even more problematic when the casting requires a closed deck where only a selected area is open to the water cooling jacket area. Closed deck engine blocks are characterized by a water jacket that is substantially closed at the top portion of the engine block, with the exception of any relatively small passages that may be present to facilitate core support, transmit gas during casting, or for creating cooling water passages to the cylinder head of the engine assembly. This closed deck design provides increased cylinder bore rigidity by adding support to the cylinder bore by bridging the cylinder bore to a water jacket wall with an integrated casting component, i.e. closing the head deck.

Thus, the water cooling passages of open deck high pressure die cast aluminum engine blocks are currently produced such that the combustion cylinders are formed using metallic cores on the inner diameter and outer diameter that leaves the cylinder walls free-standing, i.e. an open deck. This condition does not provide good structural strength to the cylinder in operation due to the high levels of stress caused during combustion, compression, and thermal stresses during engine operation. Specifically, the lack of head deck bridges in a high pressure die cast block does not provide solid support of the cylinder in operation. Moreover, the water jackets of open deck type engine blocks have to be sealed during the cylinder head assembly. This sealing process is generally very fault-prone and involved. Because of these drawbacks, large displacement aluminum engine blocks having high mechanical and thermal stress loads have not typically been produced using high pressure die casting.

While a closed deck engine block affords significantly greater load support, the prior art was limited in its ability to produce the optimum water jacket cooling passage geometry combined with the desired structural rigidity of a closed deck engine block. In that regard, U.S. Pat. No. 6,478,073 is also directed to a "Composite Core for Casting Metallic Objects" The patent details the manufacture of a salt core using a metallic arbor to provide structural support. These cores are produced using high pressure die casting and molten salt surrounding an aluminum arbor. The rigid nature of the internal arbor provides structural stability necessary for the forces of molten metal put upon the core during high pressure casting processes. The salt/aluminum core are subsequently placed in a high pressure die casting die and an aluminum engine "head" is cast around it. After casting, the salt core is dissolved by flushing with water and the aluminum arbor is extracted, leaving a cored cavity in place of the salt core. However, the arbor support is inadequate for the casting of closed deck engine blocks because the nature of the closed deck prevents the arbor from being removed. Conversely, without using an arbor as described in the '073 patent, a salt core is too fragile to withstand the high pressure die casting forces.

One closed head deck solution is Ford Global Technologies, LLC U.S. Pat. No. 6,886,505 entitled "Cylinder block and die-casting method for producing same". This patent details the production of high pressure die cast engine blocks with a closed deck water jacket by means of die core opening on the exterior surfaces of the engine block casting. However, the water jacket is open towards the engine block core requiring covers to be added to seal the water jacket with bolts. Thus, the water jacket is not fully closed when cast, nor is the engine block a unitary casting. This non-unitary casting and cover requirement adds additional steps to the manufacturing process and creates a risk of leaks that would not be present should the closed deck water jackets be a unitary casting.

Applicants are also aware of prototype cores and engine blocks produced by Buhler Die Casting Machinery of Germany and VW Automotive of Germany. Buhler developed a salt core for placement in a high pressure die cast die to form simple shape cored passages for water jacket cooling and a fully closed head deck. The cores are placed into the die and located with through-wall hole details that extend into the die. The engine block and cylinders are then cast using a hypereutectic aluminum silicon alloy. The inside of the cylinder wall is formed with a retractable, cylindrical, water-cooled tool steel core. The outer wall of the cylinder is formed by the salt core. After casting, the salt core is washed from the casting leaving the water cooling jacket passage open under the closed head deck of the block. However, since the salt core is fragile and unsupported, the prototypes have been relatively unsuccessful in that the salt cores fail during casting creating an unacceptable number of blocks that must be scrapped.

Accordingly, prior to the present invention, tooling and manufacturing trade-off decisions based the design stresses of the engine and the capability of the existing technology. Manufacturers were limited in their ability to produce the optimum water jacket cooling passage geometry while maintaining the desired structural rigidity of a closed deck engine block, particularly using the more efficient high pressure die casting method.

SUMMARY

This disclosure relates to slides and expendable cores for use in producing high pressure die cast closed deck engine blocks. Multiple small expendable cores are used in conjunction with a metallic slide that form an engine head deck, including cylinder bores and water jacket. The multiple expendable cores are used to create metal bridges between the outer water jacket surface and the cylinder bores permitting a closed deck creating improved bore stiffness.

The present disclosure is directed to a cylinder bore and water jacket slide having at least one expendable core located in the tool steel relief for the high pressure die casting of at least one closed deck engine block having at least one cylinder. The cylinder bore and water jacket slide includes at least one mandrel that receives a cast in place cylinder bore liner for forming each closed deck engine cylinder. The cylinder bore and water jacket slide further includes a tool steel portion that forms a water jacket surrounding each cylinder. The tool steel portion includes at least one, and in certain embodiments, a plurality of reliefs and has an inner surface and an outer surface. The cylinder bore and water jacket slide of the present invention also includes at least one, and in certain embodiments, a plurality of expendable cores located in the tool steel relief. Each expendable core has an inner surface and an outer surface with an aperture extending through the inner surface to the outer surface. The outer surface and inner surface of each expendable core is coextensive with the inner surface and the outer surface of the tool steel portion. The tool steel portion and each expendable core also have an upper portion and a lower portion. The lower portion of both the tool steel portion and each expendable core has a greater thickness than the upper portion. The difference in thickness between the lower portion and the upper portion defines a shelf for supporting a top surface. In one embodiment, the shelf may support a cast in place cylinder bore liner when the cast in place cylinder bore liner is received on a mandrel of the cylinder bore and water jacket slide.

As noted, each expendable core has an upper portion and a lower portion, the lower portion having a greater thickness than the upper portion. The aperture that extends through the inner surface to the outer surface is preferably located in the upper portion. However, the aperture may also be located in the lower portion in certain embodiments. The tool steel portion is separable from the expendable cores after the cylinder bore and water jacket slide is utilized in the high pressure die casting of at least one closed deck engine cylinder.

More particularly, each tool steel relief in the cylinder bore and water jacket slide includes a bottom surface, a lower inner surface, first side surface, and a second side surface. Each expendable core includes a lower portion having an inner surface and an outer surface, an upper portion having an inner surface and an outer surface, a bottom surface, a top surface, and first and second side surfaces. The inner surface of the lower portion of each expendable core engages the lower inner surface of the tool steel relief. Similarly, the bottom surface of each expendable core engages a bottom surface of tool steel relief. Likewise, the first side surface of each expendable core engages a first side surface of the tool steel relief, while the second side surface of each expendable core engages a second side surface of the tool steel relief. The inner and outer surfaces of the top portion of each expendable core are exposed to a molten alloy during casting, such that the molten alloy may flow through the aperture in the top portion of the expendable cores.

The present application is also directed to an expendable core for use in high pressure die casting of a closed engine block. The expendable core includes an inner surface, an outer surface, an upper portion, a lower portion, and an aperture extending through the expendable core from the inner surface to the outer surface in the upper portion. The lower portion has a thickness greater than the upper portion, the difference in thickness defining a shelf portion for locating the expendable core relative to a cast in place cylinder bore liner. Each expendable core also includes an outer surface on the lower portion and upper portion, a bottom surface, a top surface, a first side surface, and a second side surface. The aperture extends through the upper portion from the inner surface to the outer surface. The outer surfaces of the upper portion and the lower portion are arcuate of the same radius of curvature.

The first and second side surfaces of the expendable cores are outwardly tapering surfaces from inner surfaces and intersect with the outer surfaces of the upper portion and the lower portion. The lower tapering first and second side surfaces of the lower portion have a greater thickness than the outwardly tapering side surfaces of the upper portion. Further, the inner surface of the lower portion is a central concave surface.

The expendable cores may be constructed of salt. In other embodiments, the expendable cores may be constructed of bonded sand. In certain embodiments, the bonded sand is resin bonded green sand. In other embodiments, the bonded sand is resin bonded dry sand. In still other embodiments, the expendable core is constructed of semi-permanent metal inserts that are mechanically removed after casting. Such metal inserts may be constructed of steel, tin or zinc. In other embodiments, the expendable core is constructed of plaster, wax or foam or other melt-able or dissolvable materials. In certain embodiments, the expendable cores may be selected from a material that has a lower melting point than aluminum at 660° C. or a material having a melting point less than the eutectic temperature of aluminum-silicon alloys at 576±1° C. In this instance, the cores may be constructed of a metal such as tin or zinc or alloys thereof.

The present application also includes a method for the high pressure die casting of a closed deck engine block. The method includes placing a slide in a high pressure die casting mold for an engine block, the slide having at least one mandrel that locates a cast in place cylinder bore liner and a tool steel portion for forming at least one cylinder surrounding the cast in place cylinder bore liner along with a water jacket surrounding each cylinder. The tool steel portion includes at least one relief, and in certain embodiments, a plurality of reliefs, each having an inner surface and an outer surface defining a tool steel relief. At least one, and in certain embodiments, a plurality of expendable cores are inserted into the tool steel relief, each core having an inner surface and an outer surface with an aperture extending through the inner surface to the outer surface. A cast in place cylinder bore liner is placed over each mandrel and the high pressure die casting die is closed. A molten aluminum silicon alloy is injected into the die to create a closed deck engine block casting having at least one cylinder with a cast in place cylinder bore liner and a water jacket surrounding the at least one cylinder. The water jacket has an inner wall and an outer wall, the inner wall corresponding to the outer wall of the cast cylinder. The molten aluminum silicon alloy enters the aperture of the core to create at least one bridge between the inner wall and the outer wall of the water jacket. The closed deck engine block casting is cooled after injecting the molten aluminum silicon alloy to create the closed deck engine block. The cylinder bore and water jacket slide is removed from the high pressure die casting mold and the die casting engine block and casting. Each expendable core remains with the closed deck engine block casting and are subsequently dissolved to reveal closed deck engine block supports. The closed deck engine block supports extend between the inner wall and outer wall of the water jacket to add rigidity to each cast cylinder.

The step of inserting at least one expendable core into the reliefs may further include inserting cores having an upper portion and a lower portion, the lower portion having a greater thickness than the upper portion, the difference in thickness defining a shelf. The shelf may support the cast in place cylinder bore liner during the step of placing a cast in place cylinder bore liner over each mandrel.

In the contemplated method, each expendable core may include a lower portion having an inner surface and an outer surface, an upper portion having an inner surface and an outer surface, a bottom surface, a top surface, and first and second side surfaces. The aperture extends through the upper portion from the inner surface to the outer surface. The tool steel reliefs include a bottom surface, a lower inner surface, a first side surface, and a second side surface. In this embodiment, the step of inserting expendable cores into reliefs of the tool steel portion contemplates positioning each expendable core into relief such that the inner surface of the lower portion of each expendable core engages the lower surface of the tool steel relief. The bottom surface of each expendable core engages the bottom surface of the tool steel relief, and the first side surface of each expendable core engages the first side surface of the tool steel relief, while the second side surface of each expendable core engages the second side surface of the tool steel relief. The inner and outer surfaces of the top portion of each expendable core are exposed, and accordingly the aperture is exposed to the molten aluminum silicon alloy during casting. Further, the upper portion and the lower portion of the cores correspond to an upper portion and lower portion of the tool steel portion of the slide.

The step of placing the cast in place cylinder core liner over each mandrel may further include placing a cylinder bore liner having a top surface over each mandrel, the top surface of the cylinder core liner abutting each shelf of each inserted expendable core. One embodiment of the method further contemplates that the upper portions and the lower portions of the cores have an outer surface, and the upper portion and the lower portion of the tool steel portions of the slide have an outer surface. The outer surfaces of both the cores and the tool steel portions have the same radius of curvature.

DETAILED DESCRIPTION OF THE DRAWINGS

Figure 1:
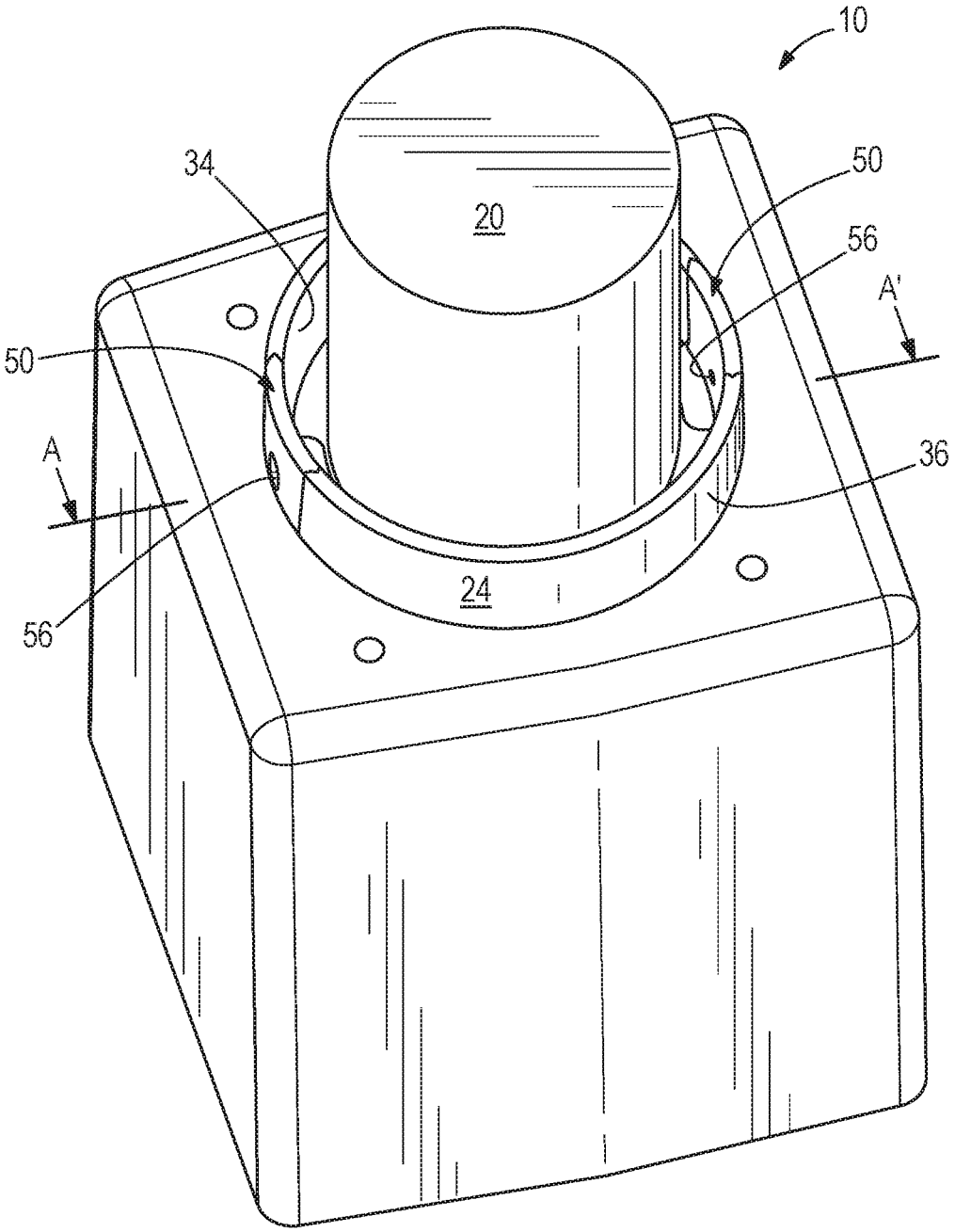
FIG. 1 is a perspective view of a cylinder bore and water jacket slide for the high pressure die casting of at least one closed deck engine cylinder, with expendable cores inserted into the slide.
Figure 10:
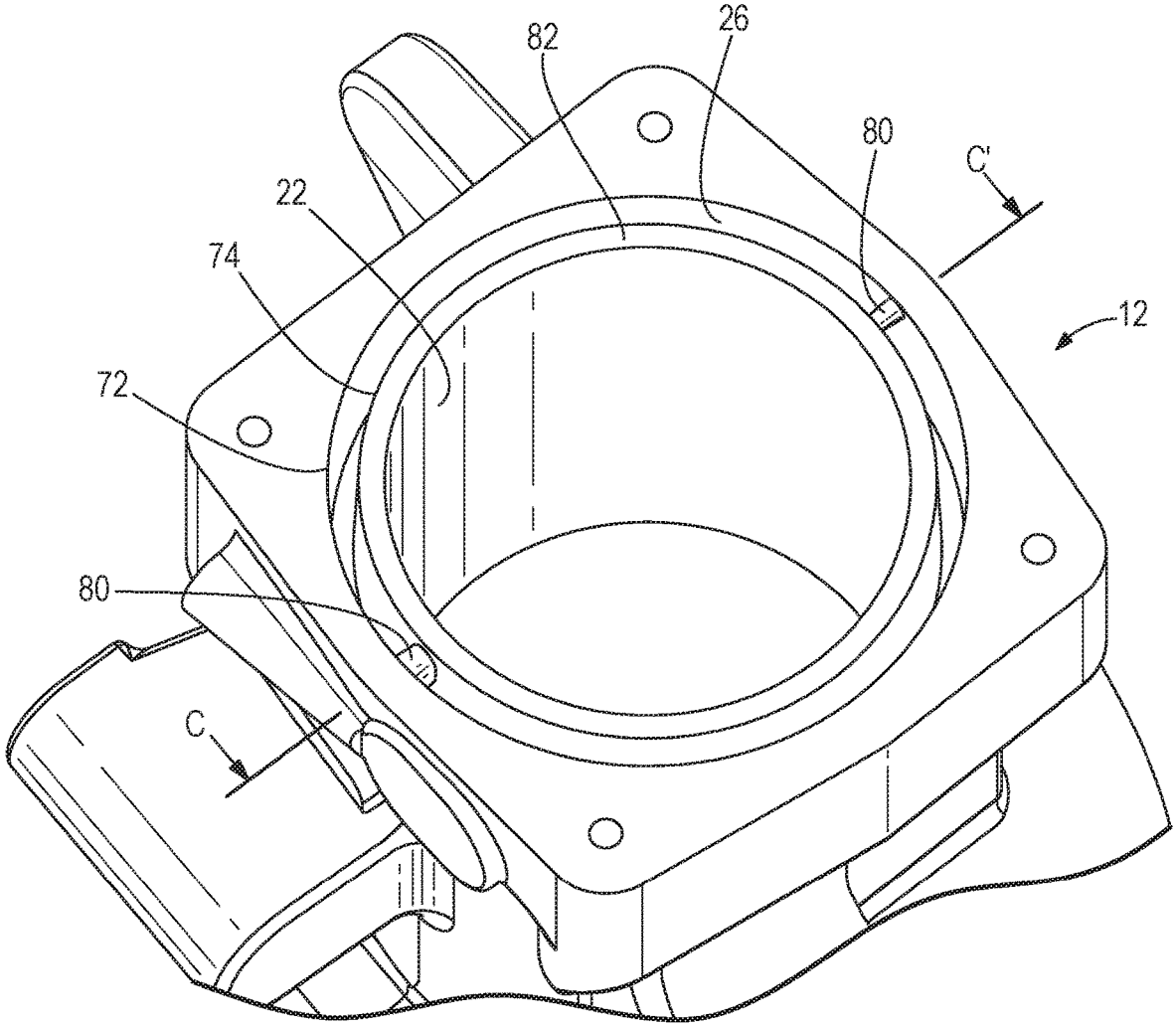
FIG. 10 is a perspective view of a closed deck engine head deck formed using the slide, expendable cores and methods of the present application.
Figure 11:
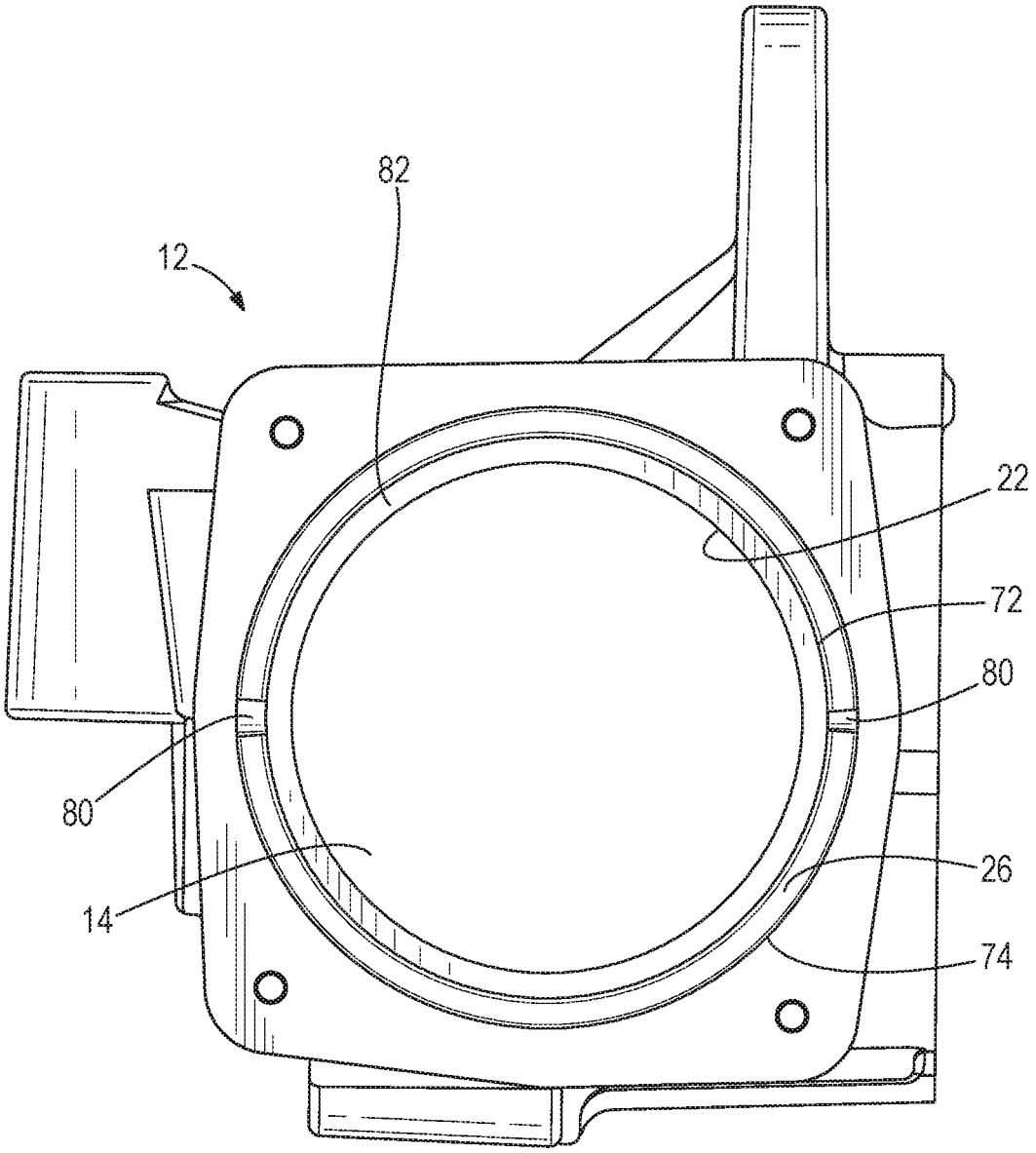
FIG. 11 is a top view of a closed deck engine head deck formed using the slide, expendable cores and methods of the present application.

Referring first to FIGS. 1, 10 and 11, the present application is directed to a cylinder bore and water jacket slide 10 for the high pressure die casting of at least one closed deck engine head deck 12 having at least one cylinder 14. The slide 10 includes at least one mandrel 20 that receives a cast in place cylinder bore liner 22 for forming each engine cylinder. While the figures depict a closed engine head deck 12 having one cylinder 14, those of ordinary skill in the art will understand that the present invention may apply to an engine head deck having a plurality of cylinders 14, including, but not limited to, two cylinder closed deck engine head decks, four cylinder closed deck engine head decks, six cylinder closed deck engine head decks, whether in-line or of a V configuration.

Referring now to FIGS. 1 through 4B, the cylinder bore and water jacket slide 10 includes a tool steel portion 24. The tool steel portion 24 is used to partially form a water jacket 26 that surrounds each cylinder 14 to aid in cooling the cylinder during engine operation. The tool steel portion 24 includes an inner surface 34 and an outer surface 36.

Figure 3:
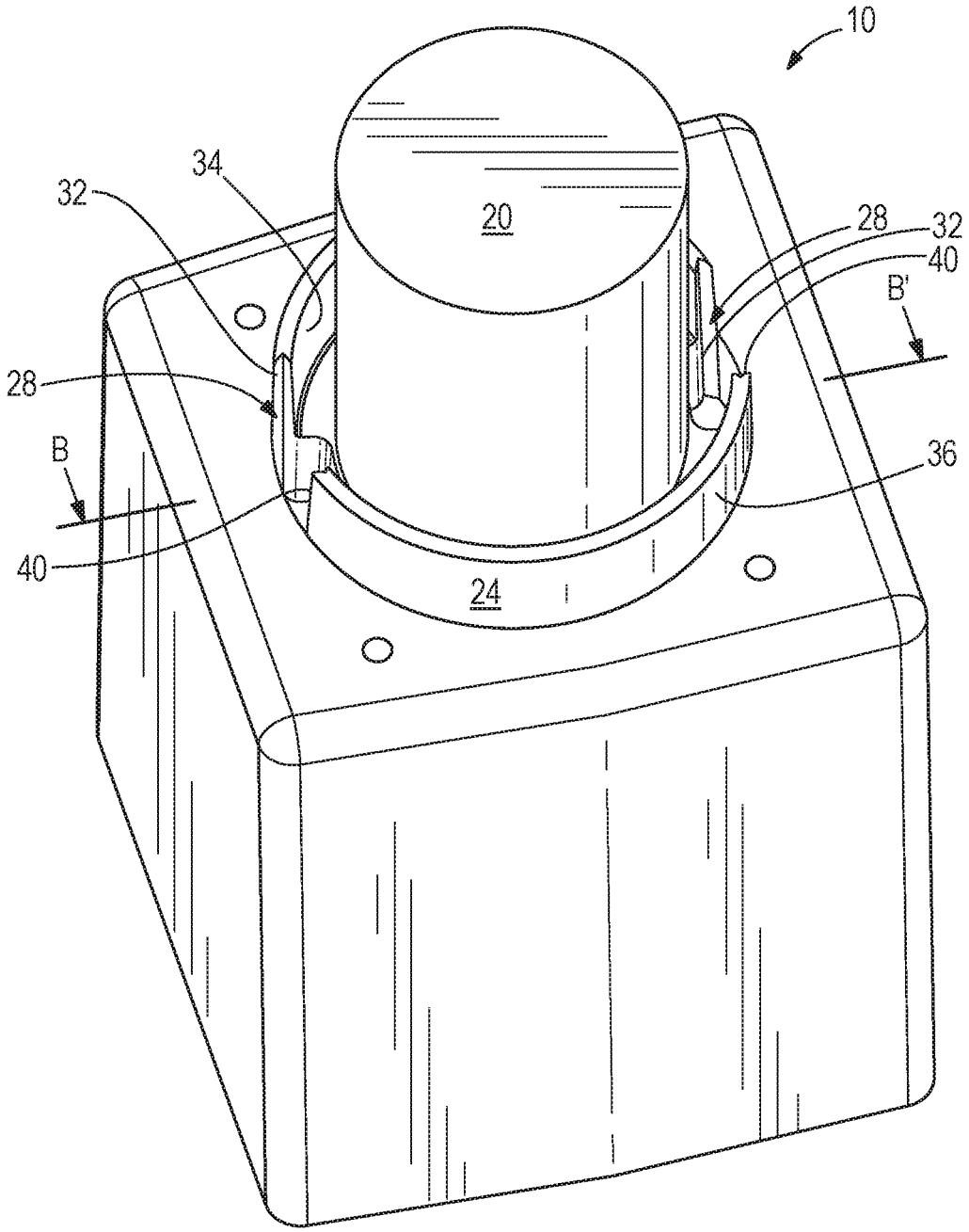
FIG. 3 is a perspective view of a cylinder bore and water jacket slide for the high pressure die casting of at least one closed deck engine cylinder, with expendable cores removed to demonstrate reliefs in the tool steel portion.
Figure 4B:
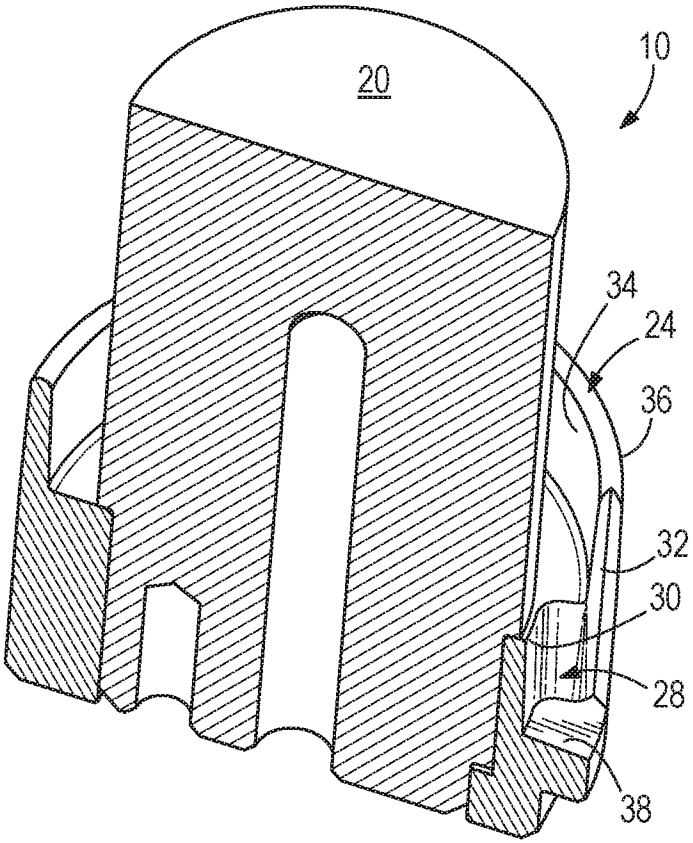
FIG. 4B is a section view similar to FIG. 4A, but demonstrating only one tool steel relief.
Figure 4A:
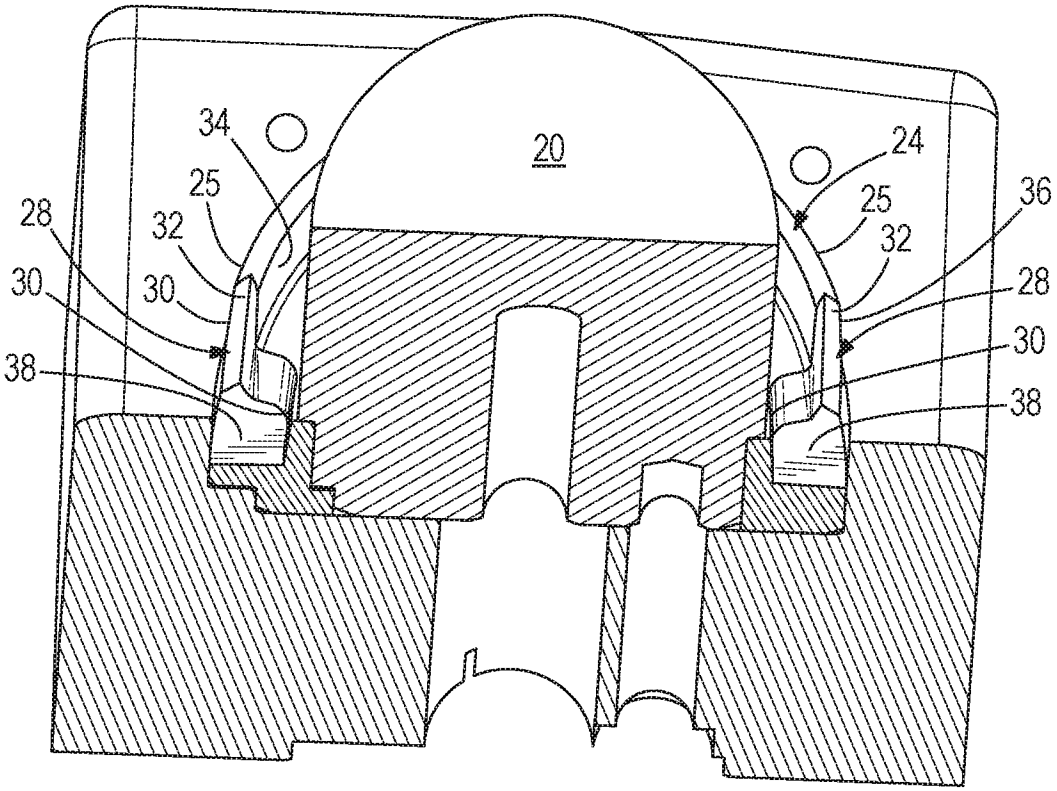
FIG. 4A is a section view of the cylinder bore and water jacket slide if FIG. 1 taken along line B-B'.
Figure 6:
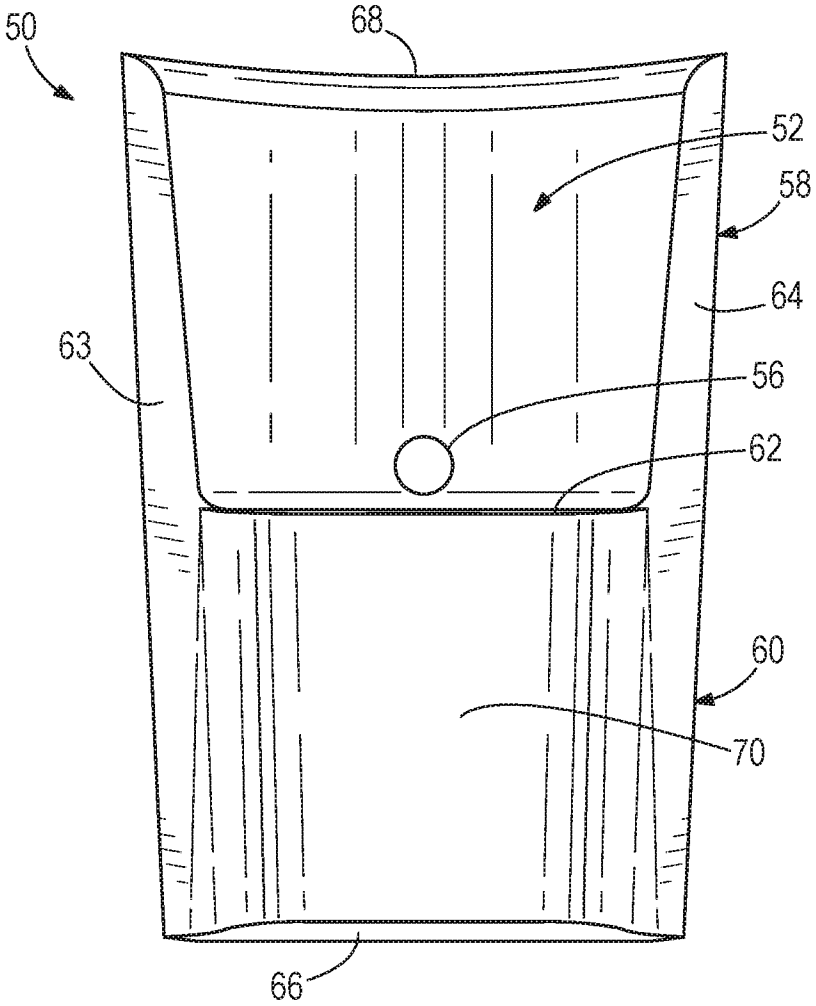
FIG. 6 is a front view of the expendable core of FIG. 5.
Figure 5:
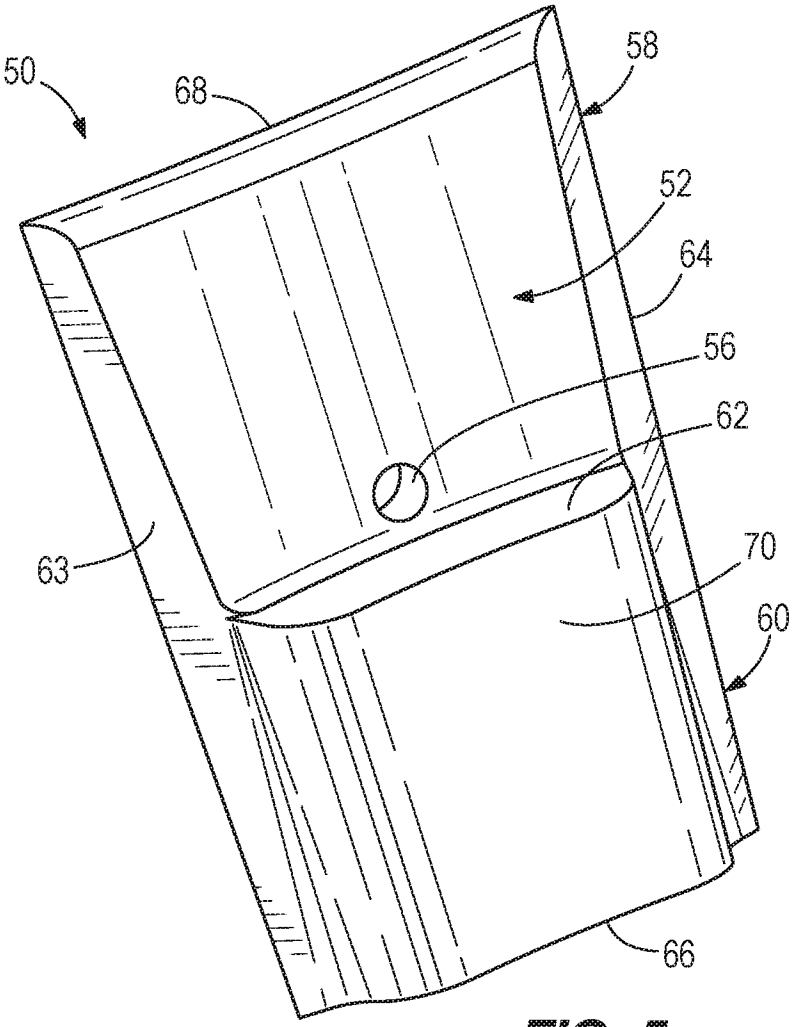
FIG. 5 is a perspective view of an expendable core in accordance with an embodiment of the present application.
Figure 7:
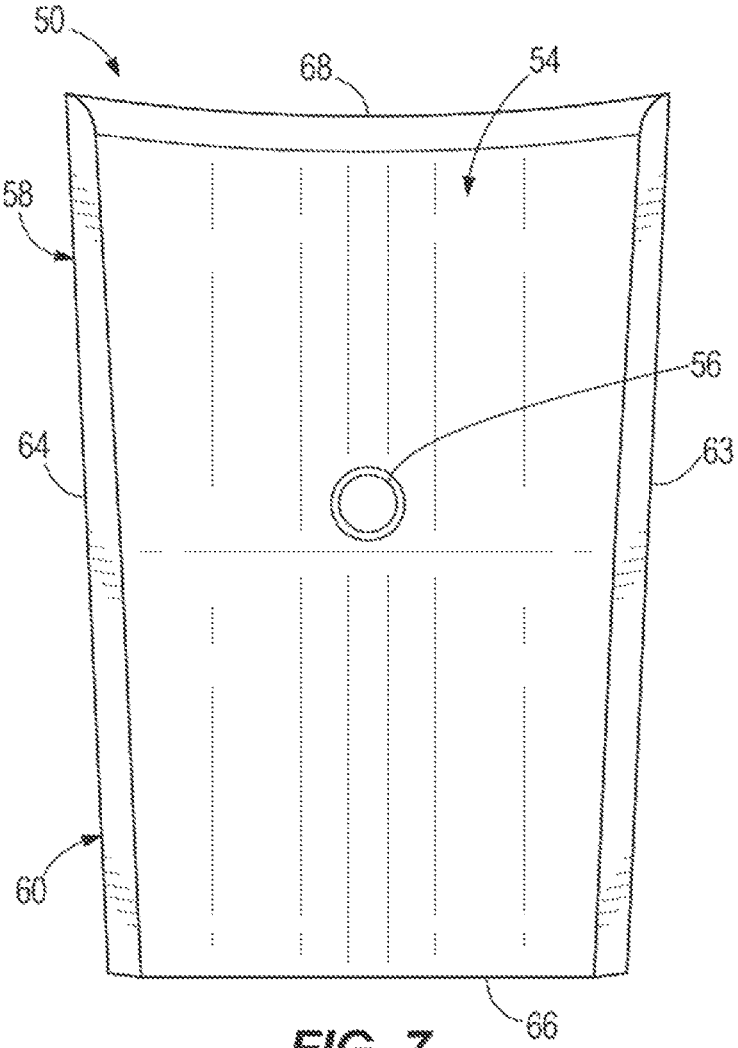
FIG. 7 is a rear view of the expendable core of FIG. 5.
Figure 8:
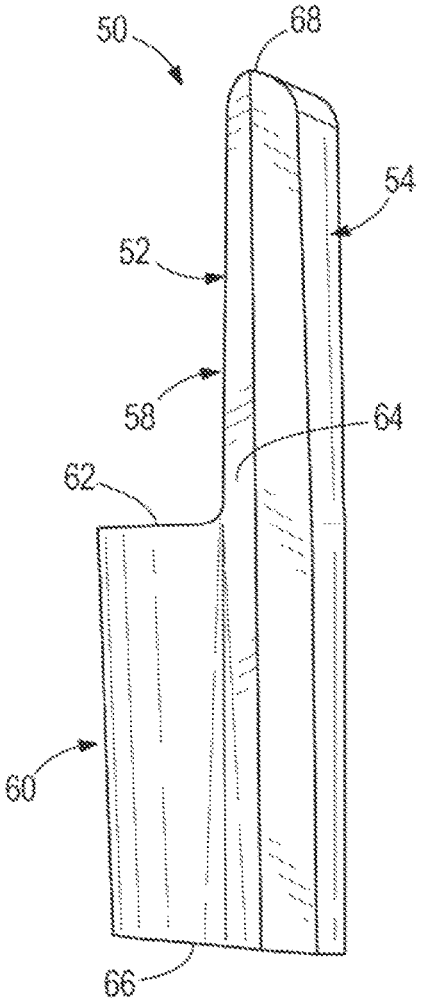
FIG. 8 is a side view of the expendable core of FIG. 5.
Figure 9:
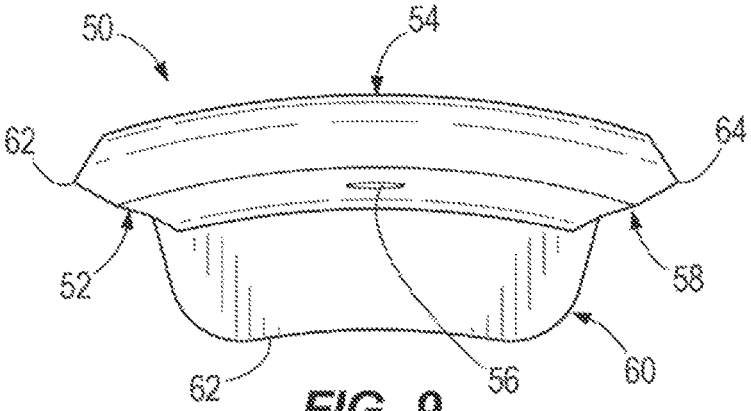
FIG. 9 is a top view of the expendable core of FIG. 5

Referring now to FIGS. 3, 4A and 4B, the tool steel portion 24 includes at least one relief 28. Preferably, the cylinder bore and water jacket slide 10 includes a plurality of tool steel reliefs 28. The tool steel reliefs 28 have an inner relief surface 30 and a side surface 32. The relief 28 further includes a bottom surface 38 and a second side surface 40.

Figure 2B:
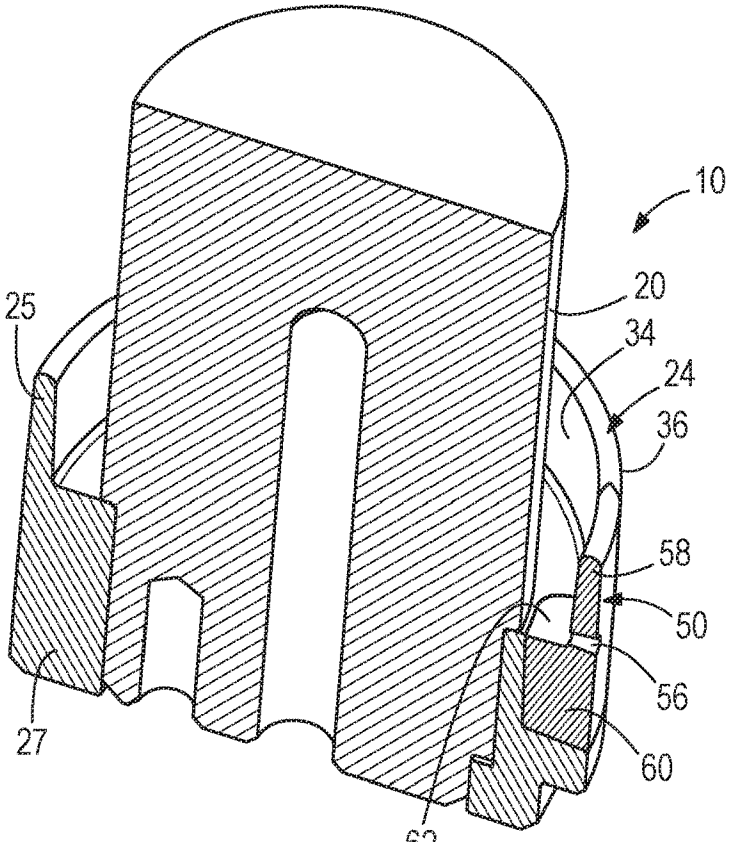
FIG. 2B is a section view similar to FIG. 2A, but demonstrating only one inserted expendable core.
Figure 2A:
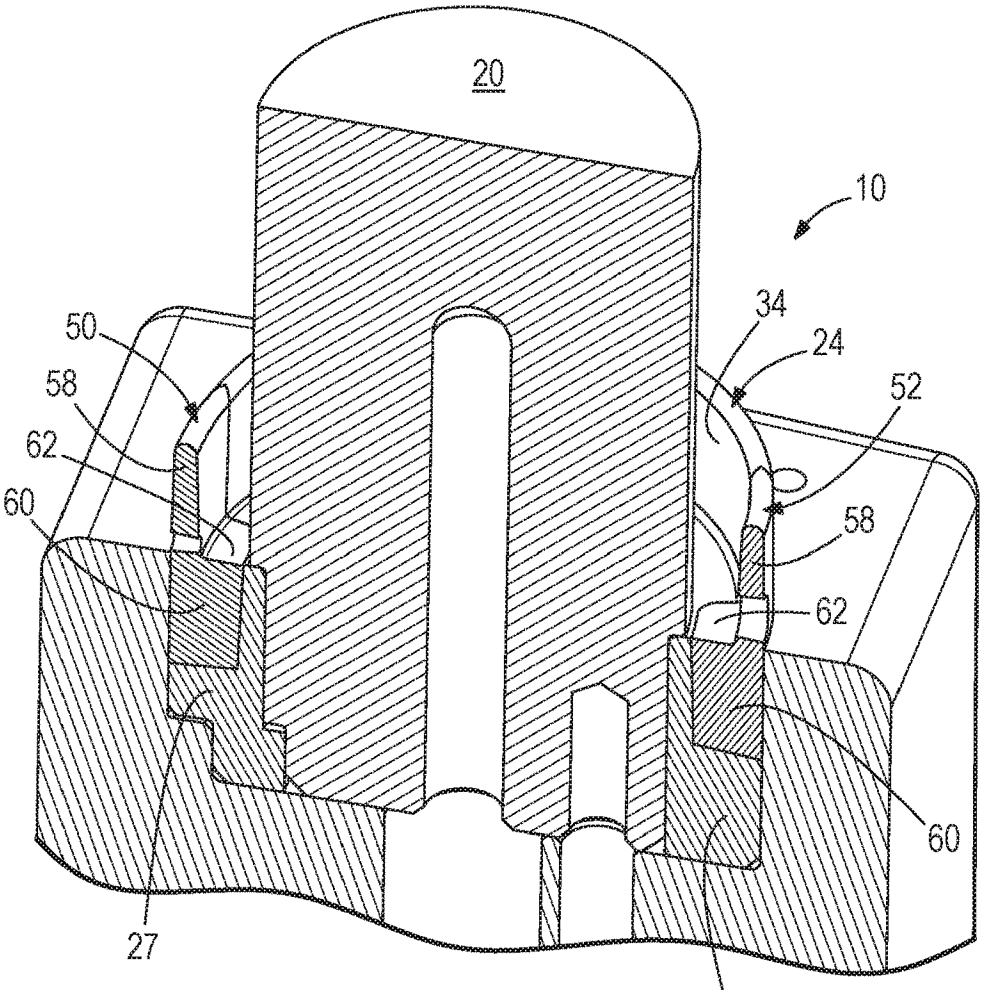
FIG. 2A is a section view of the cylinder bore and water jacket slide if FIG. 1 taken along line A-A'.

At least one, and preferably a plurality of expendable cores 50, as shown in FIGS. 1, 2A and 2B are located in the reliefs 28. Referring now to FIGS. 5-9, the expendable cores 50 have an inner surface 52 and an outer surface 54. An aperture 56 extends through the inner surface 52 to the outer surface 54. The aperture 56 may vary in circumference. As shown in FIGS. 1, 2A and 2B, when the expendable core 50 is located in the tool steel relief 28, the outer surface 54 of the expendable core 50 is coextensive with the outer surface 36 of the tool steel portion 24. Likewise, the inner surface 52 of the expendable core 50 is coextensive with the outer surface 54 of the tool steel portion 24.

Referring again to FIGS. 2A and 2B, the tool steel portion 24 includes an upper portion 25 and a lower portion 27, Likewise, the expendable core 50 has an upper portion 58 and a lower portion 60, as shown in FIGS. 5-9. The lower portion 60 of the expendable core 50 has a greater thickness than the upper portion 58. The difference in thickness between the upper portion 58 and the lower portion 60 defines a shelf 62. In one embodiment of the present application, the aperture 56 is located in the upper portion 58 of the expendable core 50. The expendable cores 50 also include a first side surface 63 and a second side surface 64. The expendable cores 50 further include a bottom surface 66 and a top surface 68.

As shown in FIGS. 1, 2A and 2B, with reference to FIGS. 3, 4A and 4B, a lower portion of the inner surface 52 of the expendable core 50 engages the inner surface 34 of the tool steel portion 24 when the expendable core 50 is inserted into the relief 28. Likewise, when the expendable core 50 is placed in the relief 28, the bottom surface 66 of the core 50 engages the bottom surface 38 of the relief 28 and the tool steel portion 24. Likewise, the first side surface 63 of the core 50 will engage the first side surface 32 of the relief 28 of the tool steel portion 24, and the second side surface 64 of the core 50 will engage the second side surface of the relief 28 of the tool steel portion 24. The expendable core 50 is placed in the relief 28 such that the tool steel portion 24, including the relief 28, is separable from the expendable core 50 after high pressure die casting of at least one closed deck engine cylinder block.

As shown in FIGS. 5-9, the outer surface 54 of the expendable core 50 is arcuate. Likewise, the inner surface 52 of the expendable core 50 is also arcuate. Despite the fact that the lower portion 60 of the expendable core 50 has a greater thickness, the radius center of the outer surface 54 on both the upper portion 58 and the lower portion 60 are the same. The first side surface 63 and the second side surface 64 of the expendable core 50 taper outwardly from the inner surface 52 and intersect with the outer surface 54. Notably, the outwardly tapering first and second side surfaces of the lower portion 60 have a greater thickness than the outwardly tapering side surfaces of the upper portion 58. In one embodiment, the inner surface 52 of the lower portion 60 includes a central concave surface 70. The expendable cores 50 may be manufactured by methods known by those having ordinary skill in the art. The expendable cores 50 may be salt cores manufactured in accordance with U.S. Pat. No. 9,527,131; the entirety of which is incorporated herein by reference. Alternatively, the expendable cores 50 may be constructed of bonded sand, such as a resin bonded sand, green sand or dry sand. Further alternatively, the expendable cores 50 may be constructed of semi-permanent metal inserts that are mechanically removed after casting. In one embodiment, the metal inserts may be selected from steel, tin or zinc. Still further, the expendable cores 50 may be constructed of plaster, wax, foam or other melt-able or dissolvable materials. In certain embodiments, the expendable cores 50 may be selected from a material that has a lower melting point than aluminum at 660° C., or from a material having a melting point less than the eutectic temperature of aluminum-silicon alloys at 577±1° C. Specifically, such melt-able expendable cores 50 may be advantageously constructed of a metal such as tin or zinc or alloys thereof.

Figure 12:
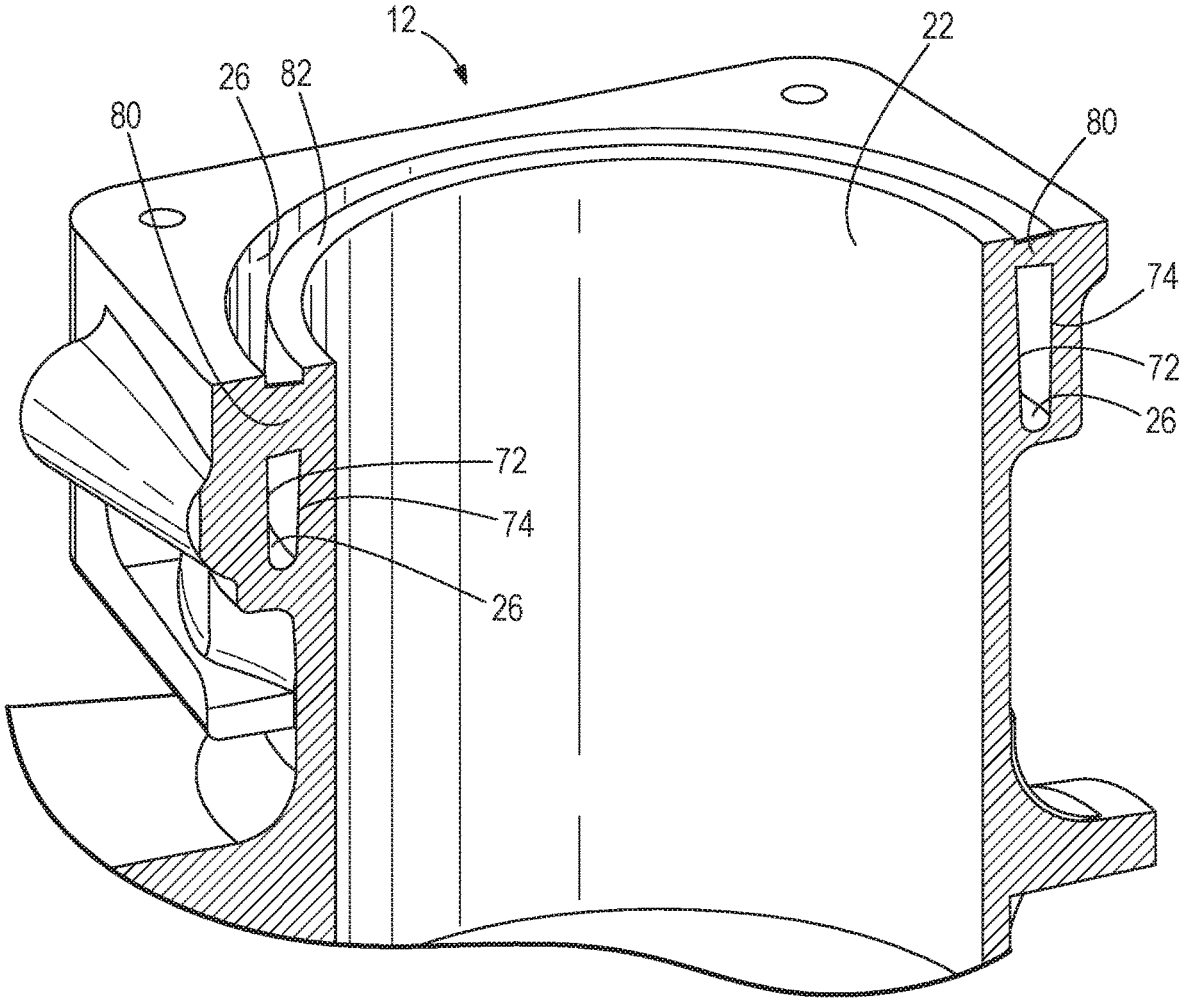
FIG. 12 is a section view of a closed deck engine head deck formed using the slide, expendable cores and methods of the present application taken along line C-C' of FIGS. 10 and 11.

Referring now to FIGS. 10, 11 and 12, the present application further contemplates a method for high pressure die casting of a closed deck engine block 12. The method contemplates placing the slide of FIG. 1 in a high pressure die casting mold for an engine block. The slide 10 has at least one mandrel 20 that locates a cast in place cylinder bore liner 22. The slide 10 further includes a tool steel portion 24 for forming at least one cylinder 14 surrounding the cast in place cylinder bore liner 22 and a water jacket 26 surrounding each cylinder 14. The tool steel portion 24, as previously described, includes at least one relief 28, the relief having an inner surface 30 defining a tool steel relief 28. The method contemplates inserting at least one expendable core 50 into the tool steel relief 28, the core 50 having an inner surface 52, and outer surface 54, and an aperture 56 extending through the inner surface 52 to the outer surface 54. The method contemplates placing a cast in place cylinder bore liner 22 over each mandrel 20, closing the high pressure die casting die, and injecting a molten aluminum silicon alloy into the die to create a closed deck engine block casting 12 having at least one cylinder 14 with a cast in place cylinder bore liner 22 and a water jacket 26 surrounding the cylinder 14. The water jacket 26 has an inner wall 72 and an outer wall 74, the inner wall 72 corresponding to an outer wall of the cast cylinder 14. During the step of injecting a molten aluminum alloy into the die, the molten aluminum silicon alloy enters the aperture 56 of the core 50 and, upon solidification, creates a bridge 80 between the inner wall 72 and the outer wall 74 of the water jacket 26. The closed deck engine block in casting is then cooled and the cylinder bore and water jacket slide are removed from the high pressure die casting mold and the closed deck engine block casting. When the slide 10 is removed, the core will remain with the closed deck engine block casting and be removed from the relief 28 of the tool steel portion 24 of the slide 10. After the closed deck engine Hock casting 12 is completely cooled, the core may be dissolved, revealing the closed deck engine block support or bridge 80. As noted, a support extends between the inner wall 72 and the outer wall 74 of the water jacket 26 and adds rigidity to each cast cylinder 14.

It must be noted that the present invention may include a casting of a closed deck engine block having multiple cylinders, including but not limited to, two, four and six cylinders in either a linear or V shape configuration. Likewise, the slide 10 may include a plurality of reliefs 28, and a plurality of cores 50 such that a plurality of supports 80 may be located along the circumference of the water jacket 26 and cylinder 14. The aperture 56 in the core 50 may vary in size, and as shown in FIGS. 10-12, cores 50 having different sized apertures 56 may be used in a slide 10 to create bridges or supports 80 of different sizes. The inventors contemplate that one bridge or support 80 will add stiffness and rigidity to the cylinder 14. However, the inventors contemplate having multiple supports 80 per cylinder, preferably two supports 80, more preferably four support 80 per cylinder, and most preferably six or more supports 80 per cylinder.

In the method of the present application, the step of inserting an expendable core 50 into a relief 28 may include a step of inserting a plurality of expendable cores 50 into a plurality of reliefs 28. As noted, the cores 50 have an upper portion 58 and a lower portion 60, with the lower portion 60 having a greater thickness than the upper portion 58, the difference in thickness defining a shelf 62. When one or more expendable cores 50 are inserted into one or more reliefs 28 of the tool steel portion 24 of the slide 10, each expendable core 50 is positioned in a relief 28 such that the inner surface 52 of the lower portion 60 of each expendable core 50 engages the lower inner surface 30 of the tool steel relief 28. Similarly, the bottom surface 66 of each core 50 will engage a bottom surface 38 of the tool steel relief 28, and the first and second side surfaces of each expendable core will engage the first and second side surfaces of the tool steel reliefs 28. After placement of one or more cores in one or more reliefs 28, the top portion 58, including the aperture 56, are exposed to the molten aluminum silicon alloy when the alloy is injected into the high pressure die casting mold.

The step of placing a cast in place cylinder bore liner 22 over each mandrel 20 may further include placing a cylinder bore liner 22 having a top surface 82 over each mandrel 20, the top surface 82 of the cylinder bore liner 22 abutting each shelf 62 of each inserted expendable core 50.

In the present disclosure, certain terms have been used for brevity, clearness and understanding. No unnecessary limitations are to be inferred therefrom beyond the requirement of the prior art because such terms are used for descriptive purposes only and are intended to be broadly construed. The different apparatuses described herein may be used alone or in combination with other apparatuses. Various equivalents, alternatives and modifications are possible within the scope of the appended claims. Each limitation in the appended claims is intended to invoke interpretation under 35 U.S.C. § 112, sixth paragraph only if the terms "means for" or "step for" are explicitly recited in the respective limitation.

What is claimed is:

1. An expendable core for use in high pressure die casting a closed deck engine block, the core comprising an arcuate inner surface, an arcuate outer surface, an upper portion, a lower portion, a top surface and a bottom surface, a first side surface and a second side surface, and an aperture extending through the core from the inner surface to the outer surface in a horizontal direction through the upper portion; wherein the entire lower portion has a thickness greater than the upper portion, the difference in thickness defining a shelf portion, wherein the thickness of the lower portion is consistent from the shelf portion to the bottom surface, wherein the first side surface and the second side surface taper outwardly from the inner surface and intersect with the outer surface, and wherein the aperture is located above the shelf portion and is parallel to a top surface of the shelf portion.

2. The expendable core of claim 1 wherein the outer surfaces of the upper portion and the lower portion are arcuate with the same radius of curvature.

3. The expendable core of claim 1 wherein the first and second side surfaces are outwardly tapering surfaces from the inner surfaces that intersect with the outer surfaces of the upper portion and the lower portion, and wherein the outwardly tapering first and second side surfaces of the lower portion have a greater thickness that the outwardly tapering side surfaces of the upper portion.

4. The expendable core of claim 3 wherein the inner surface of the lower portion includes a central concave surface.

5. The expendable core of claim 1 wherein the expendable core is constructed of salt.

6. The expendable core of claim 1 wherein the expendable core is constructed of bonded sand.

7. The expendable core of claim 6 wherein the bonded sand is resin bonded green sand.

8. The expendable core of claim 6 wherein the bonded sand is resin bonded dry sand.

9. The expendable core of claim 1 wherein the expendable core is constructed of semi-permanent steel inserts.

10. The expendable core of claim 1 wherein the expendable core is constructed of a material having a melting point less than aluminum.

11. The expendable core of claim 10 wherein the expendable core is constructed of a metal.

12. The expendable core of claim 11 wherein the metal is selected from tin, zinc or an alloy thereof.

13. The expendable core of claim 1 wherein the expendable core is constructed of a material having a melting point less than the eutectic temperature of aluminum-silicon alloys.

14. The expendable core of claim 13 wherein the expendable core is constructed of a metal.

15. The expendable core of claim 14, wherein the metal is selected from tin, zinc or an alloy thereof.

16. The expendable core of claim 1 wherein the expendable core is constructed of plaster.

17. The expendable core of claim 1 wherein the outwardly tapering first and second side surfaces of the lower portion have a greater thickness than the outwardly tapering side surfaces of the upper portion.

18. The expendable core of claim 17 wherein the expendable core is constructed of a material having a melting point less than aluminum.

19. The expendable core of claim 17 wherein the expendable core is constructed of plaster, tin, zinc or an alloy of tin or zinc.

20. The expendable core of claim 1 wherein the inner surface of the lower portion includes a central concave surface.

21. The expendable core of claim 20 wherein the expendable core is constructed of a material having a melting point less than aluminum.

22. The expendable core of claim 20 wherein the expendable core is constructed of plaster, tin, zinc or an alloy of tin or zinc.

* * * * *